United States Patent [19]

Okumura et al.

[11] Patent Number: 4,836,696

[45] Date of Patent: Jun. 6, 1989

[54] PRINTER HAVING A PIVOTALLY SUPPORTED PLATEN

[75] Inventors: Takashi Okumura; Koshiro Yamaguchi; Yoshiaki Yuki, all of Nagoya, Japan

[73] Assignee: Brother Kogyo Kabushiki Kaisha, Aichi, Japan

[21] Appl. No.: 161,151

[22] Filed: Feb. 26, 1988

[30] Foreign Application Priority Data

Mar. 3, 1987 [JP] Japan ..... 62-30955[U]

[51] Int. Cl.[4] ..... B41J 11/20

[52] U.S. Cl. ..... 400/58; 400/120; 400/643; 400/656; 403/353

[58] Field of Search ..... 400/54, 55, 58, 120, 400/643, 656, 657, 637.2, 642; 403/353, 375, 253; 101/329, 330

[56] References Cited

U.S. PATENT DOCUMENTS

| | | | |
|---|---|---|---|
| 1,007,581 | 10/1911 | Lewis | 400/643 X |
| 3,442,365 | 5/1969 | Ragland III et al. | 400/656 X |
| 4,437,780 | 3/1984 | Weber et al. | 400/642 |
| 4,549,826 | 10/1985 | Stoeberl | 400/54 X |
| 4,630,952 | 12/1986 | Elbaum | 101/330 X |

FOREIGN PATENT DOCUMENTS

| | | | |
|---|---|---|---|
| 680009 | 10/1952 | United Kingdom | 101/329 |

OTHER PUBLICATIONS

"Platen Tilt Adjustment Mechanism", *IBM Technical Disclosure Bulletin,* vol. 29, No. 1, pp. 82–83, Jun. 1986.

*Primary Examiner*—Edgar S. Burr
*Assistant Examiner*—Moshe I. Cohen
*Attorney, Agent, or Firm*—Oliff & Berridge

[57] ABSTRACT

A printing apparatus wherein a platen for supporting a recording medium printed by a print head is pivotally supported by a support member. The support member, which extends between left and right side frames of the printer, includes a first and a second engaging portion at its opposite ends. These engaging portions respectively engage an aperture and a cutout formed through the respective side frames, so that the support member and the platen are pivotally supported by the side frames. The cutout is aligned with the aperture, and is open at an edge of the corresponding side frame. This side frame includes a detent portion disposed adjacent to the cutout. The support member further includes a third engaging portion which engages the detent portion, thereby preventing the second engaging portion from being disengaged from the cutout through the open end of the cutout.

12 Claims, 2 Drawing Sheets

PRINTER HAVING A PIVOTALLY SUPPORTED PLATEN

BACKGROUND OF THE INVENTION

1. Field of the Invention

The present invention relates generally to a printing apparatus, and more particularly to a printing apparatus having a platen which is pivotally supported.

2. Discussion of the Prior Art

There is known a thermal printer wherein a thermal print head has heat-generating elements adapted to generate heat for fusing local areas of a thermal print ribbon, or alternatively, a print head has recording electrodes adapted to apply an electric current to local areas of an electrically resistive layer of a print ribbon, for causing the energized areas of the resistive layer to produce heat for fusing the corresponding areas of an ink layer of the ribbon. In this type of printing apparatus, a printing operation is effected while a recording medium is pressed by the print head against a platen of the printer, which is generally provided with a flat support surface. Accordingly, the print quality is affected by the contacting condition between the print head and the recording medium, i.e., between the print head and the platen. In view of this fact, it is proposed to provide suitable means for supporting the platen such that the platen is freely pivotable, to permit automatic angular adjustment of the platen surface, following the surface of the print head, when the printhead is moved from its retracted position to its printing position.

Various structures for pivotally supporting the platen are known and used. A typical example of such known support structure uses a support shaft for pivotally supporting a support member on which the platen is mounted. The support shaft is supported by holder members which are attached to a frame structure or housing of the printer.

The above known arrangement uses a relatively large number of component parts, and is therefore difficult to assemble, leading to an increased cost of manufacture of the printer.

Another type of known arrangement for pivotally supporting the platen uses a platen support member which is made of a flexible material. The support member is provided with shaft portions at its opposite ends. On the other hand, left and right side frames have retainer holes for receiving the shaft portions of the flexible support member. When the platen support member is mounted on the side frames, the support member is first flexed or warped in a direction perpendicular to its longitudinal direction, and then the shaft portions are inserted into the respective retainer holes. The support member recovers its original straight shape after the shaft portions are received by the holes.

Although the above arrangement uses a relatively small number of parts and is comparatively easy to assemble, the flexible support member tends to be elastically deformed due to a force exerted by the print head, and the print quality is deteriorated, during a sustained period of use of the printer.

SUMMARY OF THE INVENTION

It is therefore an object of the present invention to provide a printing apparatus having a structure for pivotally supporting a platen, which structure is economical to assemble and durable in operation.

The above object may be achieved according to the principle of the present invention, which provides a printing apparatus wherein a print head is operable to perform a printing operation on a recording medium supported by a platen, comprising: (a) a pair of side frames spaced apart from each other in a longitudinal direction of the platen, one of the side frames having an aperture formed through a thickness thereof, the other side frame having a cutout formed through a thickness thereof, the cutout being aligned with the aperture and open at an open end thereof at an edge of the other side frame; (b) a detent portion disposed adjacent to the cutout; and (c) a support member extending to support the platen. The support member includes a first engaging portion at one of opposite ends thereof and a second engaging portion at the other end. The first and second engaging portions engage the aperture and the cutout, respectively, such that the support member is pivotally supported by the pair of side frames. The support member further includes a third engaging portion which engages the detent portion, thereby preventing the second engaging portion from being disengaged from the cutout through the open end of the cutout.

In the printing apparatus of the present invention constructed as described above, the first engaging portion of the platen support member is first inserted into the aperture formed in one of the side frames, and then the second engaging portion is brought into engagement with the cutout in the other side frame. Since the cutout is open at the edge of the above-indicated other side frame, the second engaging portion may be readily inserted into the cutout through its open end. Finally, the third engaging portion of the support member is brought into engagement with the detent portion provided in the printer, in order to prevent the second engaging portion from being disengaged from the cutout.

Thus, the platen support member is easily installed on the side frames, so that the support member is freely pivotable while the first and second engaging portions of the support member are kept in engagement with the aperture and cutout. The principle of the present invention can be practiced even where the platen support member is made from a relatively rigid material such as an iron or steel plate. In this case, the support member will not be elastically warped or flexed due to a force exerted by the print head. In summary, the structure for pivotally supporting the platen according to the present invention is easy to assemble and durable in operation, and assures a high degree of print quality for a prolonged period of time.

In one form of the present invention, the first engaging portion of the support member consists of a protruding tab which has a rectangular cross sectional shape, and the aperture formed in the above-indicated one side frame consists of a pair of sectorial holes which adjoin each other at their apexes so as to form a butterfly-shaped hole. The above one side frame has a pair of opposed triangular parts which define an adjoining portion of the sectorial holes that includes the apexes, such that the two triangular parts determine a width of the butterfly-shaped hole at the adjoining portion. This width is determined to be slightly larger than a thickness of the protruding tab of the support member. The triangular parts substantially prevents a movement of the protruding tab in a direction of the thickness of the protruding tab, but permits a pivotal movement of the protruding tab within a predetermined angular range.

According to one feature of the above form of the invention, the cutout consists of a pair of sectorial holes similar to the sectorial holes of the aperture, with an exception that one of the sectorial holes of the cutout is open at the edge of the above-indicated other side frame, at an end thereof remote from the apex thereof.

According to one feature of the above form of the invention, the support member comprises an elongate member having a vertical arm and a horizontal arm which cooperate to define an L shape in transverse cross section. The elongate member is pivotally supported by the pair of side frames such that the vertical and horizontal arms take substantially vertical and horizontal postures, respectively. The platen is secured to one of opposite surfaces of the vertical arm which is remote from the horizontal arm, and the protruding tab protrudes from one of opposite longitudinal ends of the vertical arm of the elongate member.

In one arrangement according to the above feature of the invention, the second engaging portion of the support member consists of the other of the opposite longitudinal ends of the vertical arm of the elongate member.

In another arrangement of the same feature of the invention, the horizontal arm of the elongate member has an elongate hole formed through a thickness thereof, at one of opposite longitudinal ends thereof which corresponds to the other of the opposite longitudinal ends of the vertical arm. Further, the above-indicated other side frame includes an extension which serves as the detent portion. The extension has a leg portion extending in a vertical direction and a head portion extending from the leg portion in a horizontal direction. The head portion is passed through the elongate hole, and twisted in a horizontal plane so that the twisted head portion is abuttable on an edge of the elongate hole, so as to prevent the second engaging portion of the support member from being disengaged from the cutout. Thus, the edge of the elongate hole constitutes the third engaging portion of the support member, which cooperates with the head portion of the extension provided on the above-indicated other side frame as the detent portion.

The extension provided on the above-indicated other side frame may have a stop portion which extends parallel to the head portion. The elongate hole in the horizontal arm of the elongate member, and the head and stop portions of the extension are dimensioned such that the head portion is permitted to pass through the elongate hole, but the stop portion is inhibited from passing through the elongate hole, so that the horizontal arm of the elongate member is abuttable on the stop portion, thereby limiting a downward-pivotal movement of the horizontal arm. The stop portion is spaced apart from the head portion by a distance which is larger than a thickness of the horizontal arm portion of the elongate member, whereby the predetermined angular range of pivotal movement of the support member is permitted.

In another form of the present invention, the printing apparatus further comprises a paper pan for guiding the recording medium along a path which passes below and leads to the platen, and the above-indicated one and other side frames have a first and a second retainer hole, respectively. In this case, the paper pan includes: a first lug and a second lug. The first lug projects from one of opposite ends of the paper pan, for engagement with the first retainer hole in the above one side frame. The second lug projects from the other end of the paper pan, for engagement with the second retainer hole in the other side frame. The first lug has a longer distance of projection from the paper pan, than that of the second lug. The second lug is spaced apart from the other side frame when the first lug is inserted all the way into the first retainer hole, and the first lug is held in engagement with the first retainer hole even when the second lug is inserted all the way into the second retainer hole. The second lug has a bent end which engages an edge of the second retainer hole after the second lug is inserted all the way into the second retainer hole, whereby the second lug is prevented from being disengaged from the second retainer hole.

BRIEF DESCRIPTION OF THE DRAWINGS

Other features, advantages and additional objects of the present invention will become clear to those skilled in the art, from the following detailed description of a presently preferred embodiment of the invention, taken in connection with the accompanying drawings, in which.

DETAILED DESCRIPTION OF THE PREFERRED EMBODIMENT

Figure 1:
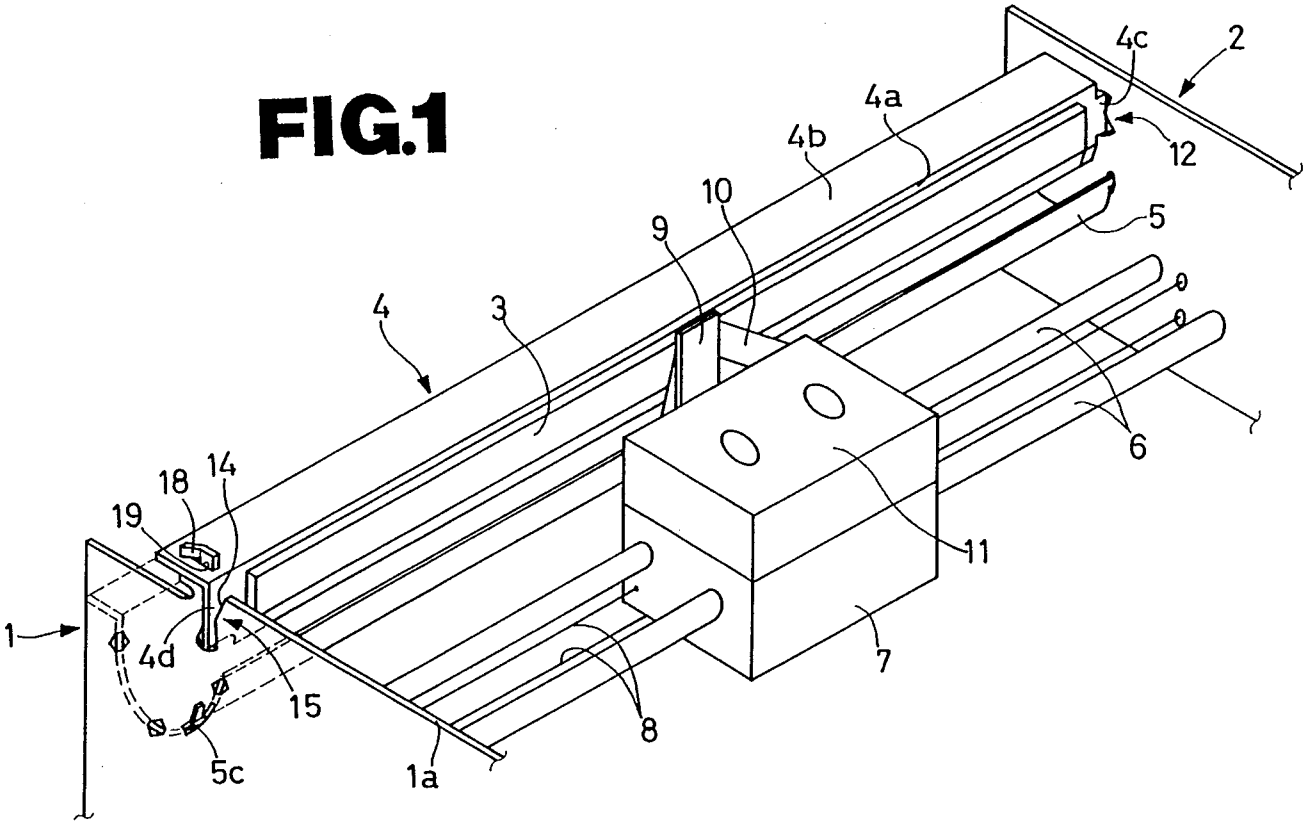
FIG. 1 is a fragmentary perspective view of the preferred embodiment of a printing apparatus of the present invention in the form of a thermal printer.

Referring first to the perspective view of FIG. 1, the thermal printer has a pair of side frames 1, 2 which are formed by bending an iron sheet, such that the left and right side frames 1, 2 face each other in a direction of printing of the printer, in a parallel spaced-apart relationship. A planar elongate platen 3 made of a rubber material is attached to an elongate support member 4, which extends between the left and right side frames 1, 2 such that the support member 4 is pivotally supported by the side frames 1, 2. The manner of mounting the support member 4 for pivotal connection with the side frames 1, 2, and the support structure associated with the support member 4 will be described later in greater detail.

Below the planar platen 3, there is disposed a paper pan 5 which extends parallel to the support member 4, between the side frames 1, 2. The paper pan 5 has an arcuate transverse cross sectional shape, so that a recording paper fed by feed and pinch rollers (not shown) from a rear section of the printer is guided by the arcuate paper pan 5, along a path which passes below and leads up to the platen 3. Thus, the recording paper is fed in front of the platen 3.

In front of the paper pan 5, there are disposed two guide rods 6 which are fixedly supported by the side frames 1, 2, so as to extend therebetween, parallel to the planar platen 3. The two guide rods 6 are located in the same horizontal plane.

A carriage 7 is slidably supported by the guide rods 6. The carriage 7 is connected to a drive motor (not shown), via a loop of wire 8 which is connected to the carriage 7 and the motor and which extends generally parallel to the guide rods 6.

The carriage 7 incorporates a support mechanism for supporting a thermal print head 9 such that the print head 9 is pivotable between its printing position in which the print head abuts on the platen 3 (recording medium placed thereon), and its retracted position in which the print head is spaced apart from the platen 3. The thermal head 9 has a suitable number of heat-generating elements which face the platen 3. The heat-generating elements are energized to effect a thermal printing operation as known in the art.

The carriage 7 carries a ribbon cassette 11 removably mounted thereon. The ribbon cassette 11 accommodates a thermal print ribbon 10 whose active exposed portion is passed between the thermal print head 9 and the platen 3. When the print head 9 is in the printing position, the active portion of the print ribbon 10 is pressed by the print head 9 against the platen 3 (via the recording medium). During a printing operation, the heat-generating elements of the print head 9 are selectively activated to heat corresponding local areas of the recording medium and thereby print images in a matrix of dots, while the carriage 7 is moved along the platen 3. Certainly, the thermal print ribbon 10 is fed by a suitable feed mechanism, from a supply spool to a take-up spool. These feed mechanisms and spools are well known in the art, and no detailed description is deemed necessary for the understanding of the present invention.

Figure 2:
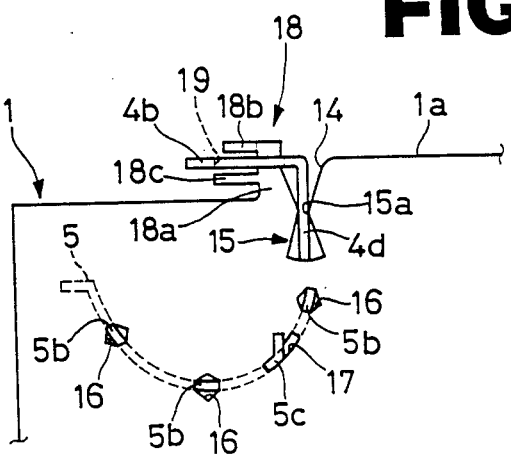
FIG. 2 is a left side elevational view of the printer of FIG. 1.
Figure 3:
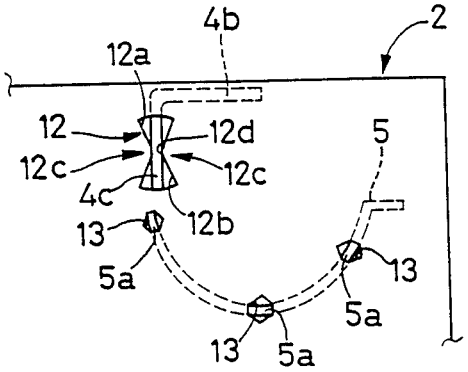
FIG. 3 is a right side elevational view of the printer of FIG. 1.

Referring further to FIGS. 2 and 3, the structure for pivotally supporting the platen support member 4 will be described in detail.

As most clearly shown in FIG. 3, the right side frame 2 has an aperture in the form of a butterfly-shaped hole 12 for pivotally supporting the support member 4, and three first retainer holes 13 for supporting the paper pan 5 at its right end. The butterfly-shaped hole 12 is generally elongate in the vertical direction, and consists of a pair of generally sectorial holes **12*a*, 12*b* which adjoin each other at their apexes, such that the two holes 12*a*, 12*b* are symmetrical with each other with respect the apexes. Namely, the right side frame 2 has a pair of opposed triangular parts 12*c*, 12*c* which define an adjoining portion of the sectorial holes 12*a*, 12*b*. The triangular parts 12*c*, 12*c* define a minimum width 12*d* of the butterfly-shaped hole 12 at the adjoining portion of the adjoining sectorial holes 12*a*, 12*b*. In other words, the adjoining portion has the width 12*d*, which is slightly larger than a thickness of a protruding tab 4*c* which extends from the right-hand side end of a vertical arm 4*a* of the elongate support member 4**.

The support member 4 is formed from an L-shaped iron plate which has a rigidity or strength sufficient to withstand a force exerted by the thermal print head 9. The L-shaped support member 4 consists of the vertical arm **4*a* (indicated above) and a horizontal arm 4*b* which take substantially vertical and horizontal positions or postures when the support member 4 is supported by the side frames 1, 2 as described below. The platen 3 is attached to the front surface of the vertical arm 4*a***.

As most clearly shown in FIG. 2, the left side frame 1 has a cutout in the form of a butterfly-shaped hole 15 which is similar to the butterfly-shaped hole 12 formed in the right side frame 2, with an exception that an upper one of the adjoining two sectorial holes is open as indicated at 14 in FIG. 2, at an upper edge **1*a* of the left side frame 1. This cutout or butterfly-shaped hole 15 is aligned with the aperture or butterfly-shaped hole 12. The width of the hole 15 indicated at 15*a* is slightly larger than the thickness of the vertical arm 4*a* of the support member 4**.

The left side frame 1 further has three second retainer holes 16 which are aligned with the corresponding three first retainer holes 13 formed in the right side frame 2. The side frame 1 further has an additional second retainer hole 17. These second retainer holes 16, 17 are provided for supporting the paper pan 5 at its left end, as described below. The left side frame is formed with a detent portion in the form of an extension 18 disposed adjacent to the open end 14 of the butterfly-shaped hole or cutout 15. The extension 18 consists of a vertical leg portion **18*a* extending vertically from the upper edge 1*a* of the side frame 1, a horizontal head portion 18*b* extending horizontally from the upper end of the leg portion 18*b*, and a horizontal stop portion 18*c* extending horizontally from a middle part of the vertical leg portion 18*a* parallel to the head portion 18*b*. The distance between the head portion 18*b* and the stop portion 18*c* is larger than the thickness of the horizontal arm 4*b* and is dimensioned so as to permit a pivotal movement of the support member 4 within a predetermined angular range. While FIG. 1 shows the head portion 18*b* as being slightly twisted in the horizontal plane after the support member 4 is installed on the side frames 1, 2, the head portion 18*b* is parallel to the side frame 1 before the support member 4** is installed.

The protruding tab **4*c* extending from the right end of the vertical arm 4*a* of the elongate support member 4 functions as a first engaging portion which is adapted to be inserted into the aperture in the form of the butterfly-shaped hole 12, such that the vertical arm 4*a* is pivotable in the hole 12. The support member 4 is dimensioned so that when the protruding tab 4*c* is inserted all the way into the hole 12 in the right side frame 2, the left-side end of the vertical arm 4*a* indicated at 4*d* in FIG. 1 remains in the butterfly-shaped hole 15 in the left side frame 1. The left-side end 4*d* of the vertical arm 4*a* functions as a second engaging portion which engages the left side frame 1 such that the vertical arm 4*a* is pivotable in the hole 15**.

The left-side end portion of the horizontal arm **4*b* of the support member 4 has an elongate hole 19 parallel to the side frame 1. This elongate hole 19, and the head and stop portions 18*b*, 18*c* of the detent portion 18 extending from the side frame 1 are dimensioned such that the head portion 18*b* can pass through the elongate hole 19, but the stop portion 18*c* cannot pass through the hole 19**.

When the support member 4 for supporting the platen 3 is installed on the side frames 1, 2, the protruding tab **4*c* is initially inserted all the way into the butterfly-shaped hole 12 in the right side frame 2, while the support member 4 is held inclined downwardly on its right-hand side, until the right end of the vertical arm 4*a* abuts on the inner surface of the side frame 2. In this condition, the left end 4*d* of the vertical arm 4*a* is positioned right above the butterfly-shaped hole 15 in the left side frame 1. Then, the left end portion of the support member 4 is lowered until the left end 4*d* of the vertical arm 4*a* is received in the hole 15, via its upper open end 14. The head portion 18*b* of the detent portion or extension 18 of the left side frame 1 is then twisted as with pliers in the horizontal plane, so that the twisted head portion 18*b* is abuttable on the edge of the elongate hole 19. This edge functions as a third engaging portion of the support member 4, i.e., which cooperates with the detent portion 18 to constitute means for preventing the second engaging portion 4*d* from being disengaged from the butterfly-shaped hole or cutout 15**.

The thus installed support member 4 is pivotable about a point near the center of each butterfly-shaped hole 12, 15, i.e., about the adjoining portion of the two sectorial holes which constitutes the butterfly-shaped hole 12, 15. This pivotal movement is permitted since the widths 12*d*, 15*a* of the holes 12, 15 are slightly larger than the thickness of the vertical arm 4*a* (protruding tab 4*c* and left end 4*d*) of the support member 4, and since the head and stop portions 18*b*, 18*c* of the detent portion 18 are spaced apart from each other by a suitable distance. In this arrangement, the platen 3 on the pivotally supported support member 4 can be freely pivoted following the contacting surface of the thermal print head 9 when the head 9 is moved to its printing position. As a result, the print head 9 can contact the recording paper on the pivotally supported platen 3, with a uniform surface pressure over the entire contacting surface.

When the print head 9 is returned to its retracted non-printing position, the support member 4 and the platen 3 are pivoted in the rear direction due to the weight of the support member 4. However, this pivotal movement is limited by the stop portion 18*c* of the detent portion 18, which abuts on the lower surface of the horizontal arm 4*b* of the support member 4.

It will be understood that the butterfly-shaped holes 12, 15 are shaped and dimensioned so as to permit the pivotal movement of the support member 4 within the predetermined angular range. Further, the twisted head portion 18*b* of the detent portion 18 of the left side frame 1 prevents the left end 4*d* of the vertical arm 4*a* of the support member 4 from being disengaged from the hole 15 through its upper open end 14.

Then, the structure for supporting the paper pan 5 on the side frames 1, 2, and the procedure for installing the paper 5 will be described.

The paper pan 5 has three first lugs 5*a* projecting from its right end for engagement with the respective three first retainer holes 13 formed through the right side frame 2, and three second lugs 5*b* projecting from its left end for engagement with the respective three retainer holes 16 formed through the left side frame 1. The paper pan 5 further has an additional second lug 5*c* which projects from its left end, for engagement with the additional second retainer hole 17 in the left side frame 1. This additional second lug 5*c* has a bent end which is held in engagement with the edge of the additional second retainer hole 17, on the outer surface of the side frame 1.

Described more specifically, the distance of projection of the first lugs 5*a* is longer than that of and the projecting distance of the second lugs 5*b*, 5*c* are determined so that the second lugs 5*b*, 5*c* are spaced apart from the inner surface of the left side frame 1 when the first lugs 5*a* are inserted all the way into the first retainer holes 13, and so that the first lugs 5*a* are held in engagement with the retainer holes 13 even when the second lugs 5*b*, 5*c* are inserted all the way into the retainer holes 16, 17.

When the paper pan 5 is installed on the side frames 1, 2, the first or right lugs 13 are first inserted all the way into the corresponding retainer holes 5*a*. Then, the paper pan 5 is moved to the left in order to insert the second or left lugs 5*b*, 5*c* all the way into the corresponding retainer holes 16, 17. Finally, the free end of the additional second lug 5*c* is bent, as with pliers, against the edge of the hole 17, on the outer surface of the left side frame 1. The bent end of the lug 5*c* functions as means for preventing the paper pan 5 from moving in a direction away from the left side frame 1.

The thus installed paper pan 5 is positioned and fixed by the first and second lugs 5*a*, 5*b* in the vertical direction and the front-rear horizontal direction, and is prevented by the additional second lug 5*c* from moving in the longitudinal direction.

While the present invention has been described in its presently preferred embodiment with a certain degree of particularity, it is to be understood that the invention is not limited to the details of the illustrated embodiment, but may be embodied with various changes, modifications and improvements, which may occur to those skilled in the art, without departing from the spirit and scope of the invention defined in the following claims.

What is claimed is:

1. A printing apparatus wherein a print head is operable in a printing position thereof to perform a printing operation on a recording medium supported by a substantially flat support surface of a platen, comprising:

a pair of side frames spaced apart from each other in a longitudinal direction of said platen;

one of said side frames having an aperture formed through a thickness thereof;

the other of said side frames having a cutout formed through a thickness thereof, and a detent portion disposed adjacent to said cutout, said cutout being aligned with said aperture and being open at an open end thereof at an edge of said other side frame; and a support member extending to support said platen, and including a first engaging portion at one of opposite ends thereof and a second engaging portion at the other end thereof, said first and second engaging portions engaging said aperture and said cutout, respectively, such that said support member is freely pivotable due to contact of said print head with said platen upon movement of said print head to said printing position, said support member further including a third engaging portion which engages said detent portion, thereby preventing said second engaging portion from being disengaged from said cutout through said open end of the cutout.

2. A printing apparatus according to claim 1, wherein said first engaging portion of said support member consists of a protruding tab which has a rectangular cross sectional shape, and said aperture formed in said one side frame consists of a pair of sectorial holes which adjoin each other at apexes thereof so as to form a butterfly-shaped hole, said one side frame having a pair of opposed triangular parts which define an adjoining portion of said sectorial holes that includes said apexes, such that said pair of triangular parts determine a width of said butterfly-shaped hole at said adjoining portion, said width being slightly larger than a thickness of said protruding tab of said support member, and said pair of triangular parts substantially preventing a movement of said protruding tab in a direction of the thickness of the protruding tab, and permitting a pivotal movement of said protruding tab within a predetermined angular range.

3. A printing apparatus according to claim 2, wherein said cutout consists of a pair of sectorial holes similar to said pair of sectorial holes of said aperture, except that one of said pair of sectorial holes of said cutout is open at said edge of said other side frame, at an end thereof remote from the apex thereof.

4. A printing apparatus according to claim 2, wherein said support member comprises an elongate member having a vertical arm and a horizontal arm which cooperate to define an L shape in transverse cross section, said elongate member being pivotally supported by said pair of side frames such that said vertical and horizontal arms take substantially vertical and horizontal postures, respectively, said platen being secured to one of opposite surfaces of said vertical arm which is remote from said horizontal arm, said protruding tab protruding from one of opposite longitudinal ends of said vertical arm of said elongate member.

5. A printing apparatus according to claim 4, wherein said second engaging portion of said support member consisting of the other of said opposite longitudinal ends of said vertical arm of said elongate member.

6. A printing apparatus according to claim 4, wherein said horizontal arm of said elongate member has an elongate hole formed through a thickness thereof, at one of opposite longitudinal ends thereof which corresponds to the other of said opposite longitudinal ends of said vertical arm, said other side frame including an extension as said detent portion which has a leg portion extending in a vertical direction and a head portion extending from said leg portion in a horizontal direction, said head portion being passed through said elongate hole, and twisted in a horizontal plane so that the twisted head portion is abuttable on an edge of said elongate hole, said edge constituting said third engaging portion.

7. A printing apparatus according to claim 6, wherein said extension of said other side frame further has a stop portion which extends parallel to said head portion, said elongate hole in said horizontal arm of said elongate member, and said head and stop portions of said extension being dimensioned such that said elongate hole permits a passage of said head portion therethrough, and inhibits a passage of said stop portion therethrough so that said one end of said horizontal arm of said elongate member is abuttable on said stop portion, thereby limiting a downward pivotal movement of said horizontal arm, said stop portion being spaced apart from said head portion by a distance which is larger than a thickness of said horizontal arm portion of said elongate member, whereby said predetermined angular range of pivotal movement of said support member is permitted.

8. A printing apparatus according to claim 1, further comprising a paper pan for guiding said recording medium along a path which passes below and leads to said platen, and wherein said one side frame and said other side frame have a first and a second retainer hole, respectively, said paper pan including:

a first lug which projects from one of opposite ends of said paper pan and which engages said first retainer hole in said one side frame;

a second lug which projects from the other end of said paper pan and which engages said second retainer hole in said other side frame;

said first lug having a longer distance of projection from said one end of the paper pan than that of said second lug from said other end of the paper pan, said second lug being spaced apart from said other side frame when said first lug is inserted all the way into said first retainer hole, and said first lug being held in engagement with said first retainer hole even when said second lug is inserted all the way into said second retainer hole; and said second lug having a bent end which engages an edge of said second retainer hole after said second lug is inserted all the way into said second retainer hole, whereby said second lug is prevented from being disengaged from said second retainer hole.

9. A printing apparatus wherein a print head is operable to perform a printing operation on a recording medium supported by a platen, comprising:

a pair of side frames spaced apart from each other in a longitudinal direction of said platen;

one of said side frames having at least one first retainer hole formed through a thickness thereof, and the other side frame having at least one second retainer hole formed through a thickness thereof;

a paper pan for guiding said recording medium along a path which passes below and leads to said platen;

at least one first lug which projects from one of opposite ends of said paper pan and which engages said at least one first retainer hole in said one side frame;

a second lug which projects from the other end of said paper pan and engages said at least one second retainer hole in said other side frame;

said at least one first lug having a longer distance of projection from said one end of the paper pan than that of said at least one second lug from said other end of the paper pan, said at least one second lug being spaced apart from said other side frame when said at least one first lug is inserted all the way into said at least one first retainer hole, and said at least one first lug being held in engagement with said at least one first retainer hole even when said at least one second lug is inserted all the way into said at least one second retainer hole; and stop means for preventing said paper pan from moving in a direction away from said other side frame while said at least one second lug is kept inserted all the way into said at least one second retainer hole.

10. A printing apparatus according to claim 9, wherein said stop means consists of a free end of said at least one second lug, said free end being bent so as to extend in a plane parallel to said other side frame and engage an edge of said at least one second retainer hole, after said second lug is inserted all the way into said at least one second retainer hole.

11. A printing apparatus wherein a print head is operable in a printing position thereof to perform a printing operation on a recording medium supported by a substantially flat support surface of a platen, comprising:

a pair of side frames spaced apart from each other in a longitudinal direction of said platen;

one of said side frames having an aperture formed through a thickness thereof, said one side frame including a first part which defines one of opposite ends of said aperture, and a pair of opposed spaced-apart second parts which define a narrowest portion of said aperture intermediate between said opposite ends;

the other of said side frames having a cutout formed through a thickness thereof, and a detent portion disposed adjacent to said cutout, said cutout being aligned with said aperture and being open at an open end thereof at an edge of said other side frame, said other side frame including a third part which defines a closed end of said cutout aligned with said one end of said aperture, and a pair of opposed spaced-apart fourth parts which define a narrowest portion of said cutout intermediate between said closed and open ends; and a support member extending to support said platen, and including a first flat engaging portion at one of opposite ends thereof and a second flat engaging portion at the other end thereof, said first flat engaging portion engaging said first and second parts of said one side frame while said second flat engaging portion engaging said third and fourth parts of said other side frame, such that said support member is freely pivotable due to contact of said print head with said platen upon movement of said print head to said printing position, said support member further including a third engaging portion which engages said detent portion, thereby preventing said second engaging portion from being disengaged from said cutout through said open end of the cutout.

12. A printing apparatus wherein a print head is operable in a printing position thereof to perform a printing operation on a recording medium supported by a substantially flat support surface of a platen, comprising:

a pair of side frames spaced apart from each other in a longitudinal direction of said platen;

one of said side frames having an aperture formed through a thickness thereof;

the other of said side frames having a cutout formed through a thickness thereof, said cutout being aligned with said aperture and being open at an open end thereof at an edge of said other side frame;

said other side frame comprising a detent portion disposed adjacent to said cutout, so as to extend from said edge;

a support member extending to support said platen, and including a first engaging portion at one of opposite ends thereof and a second engaging portion at the other end thereof, said first and second engaging portions engaging said aperture and said cutout, respectively, such that said support member is freely pivotable due to contact of said print head with said platen upon movement of said print head to said printing position; and said support member having an elongate hole through which a head of said detent portion extends, said head of said detent portion being bent so as to engage a portion of said other side frame defining said elongate hole, thereby preventing said second engaging portion from being disengaged from said cutout through said open end of the cutout.

* * * * *